United States Patent [19]

Feldt et al.

[11] 4,428,162

[45] Jan. 31, 1984

[54] GRINDING MACHINE AND CONTROL FOR REMOVING BURRS OR FINS FROM WORKPIECES SUCH AS CASTINGS

[75] Inventors: Wolfgang Feldt, Grundau; Walter Bautz, Darmstadt, both of Fed. Rep. of Germany

[73] Assignee: M.A.N.-Roland Druckmaschinen Aktiengesellschaft, Fed. Rep. of Germany

[21] Appl. No.: 351,226

[22] Filed: Feb. 22, 1982

Related U.S. Application Data

[63] Continuation-in-part of Ser. No. 172,090, Jul. 25, 1980, abandoned.

[30] Foreign Application Priority Data

Jul. 26, 1979 [DE] Fed. Rep. of Germany ..... 2930309

[51] Int. Cl.[3] ..... B24B 49/16

[52] U.S. Cl. ..... 51/165.77; 51/165.92

[58] Field of Search ..... 51/165.77, 165 R, 165.92, 51/166 MH, 166 T

[56] References Cited

U.S. PATENT DOCUMENTS

| | | | |
|---|---|---|---|
| 2,707,855 | 5/1953 | Miller | 51/166.7 |
| 3,589,077 | 6/1968 | Lenning | 51/165 |
| 3,897,660 | 8/1975 | Chijiiwa et al. | 51/165.77 |
| 3,948,001 | 4/1976 | Miyazawa et al. | 51/137 |
| 4,075,792 | 2/1978 | Schreiber | 51/165.92 |
| 4,193,227 | 3/1980 | Uhtenwoldt | 51/165.77 |
| 4,228,782 | 10/1980 | Demers | 125/14 |

FOREIGN PATENT DOCUMENTS

| | | | |
|---|---|---|---|
| 782432 | 9/1957 | United Kingdom | 51/165.92 |

*Primary Examiner*—Harold D. Whitehead

*Attorney, Agent, or Firm*—Leydig, Voit, Osann, Mayer & Holt, Ltd.

[57] ABSTRACT

A method and a device for the automatic removal of burrs or fins from workpieces such as castings by a grinding process. A feed for moving the workpiece perpendicular to the grinding wheel radius is provided for grinding along the length of the burr. A second constant velocity feed of reversible and alternating direction is provided for moving the grinding wheel radially into the workpiece. The load or circumferential torque on the grinding wheel is monitored to detect the abrupt increase in torque occurring when the grinding wheel has cut through the burr and encounters the body of the workpiece, whereupon the direction of the radial feed is reversed so that the grinding process follows the contour of the workpiece.

20 Claims, 14 Drawing Figures

Mz
My
Mw
Ms
Mx
X
Y
Z
W
S

GRINDING MACHINE AND CONTROL FOR REMOVING BURRS OR FINS FROM WORKPIECES SUCH AS CASTINGS

RELATED APPLICATIONS

This application is a continuation in part of Feltd, Wolfgang and Bautz, Walter application Ser. No. 6/172,090 filed July 25, 1980 now abandoned.

BACKGROUND OF THE INVENTION

This invention relates to grinding machines in which the grinding wheel and workpiece can be moved in relation to each other by motorized controllable feeds. More particularly, the invention pertains to the adaption and use of such grinding machines for automatic removal of the burr or fin on the workpiece such as a casting.

DESCRIPTION OF THE PRIOR ART (Prior Art Statement Under Rule 97)

A grinding machine with motorized, controllable feeds is disclosed in Chijiiwa et al. U.S. Pat. No. 3,897,660 issued Aug. 5, 1975. Control of the feed of the grinding wheel into the workpiece is obtained by pressing the wheel radially into the workpiece with constant force by spring pressure. The force is measured by the spring deflection, and the feed is controlled to counteract any change in spring deflection so that force is maintained at a constant value as the grinding wheel cuts into the burr.

Although the spring is useful for keeping the force constant when otherwise it would sharply rise when the body of the workpiece is contacted by the grinder, there is no reference to the actual contour of the workpiece. Thus, the machine does not detect the arrival of the actual contour of the workpiece. Accordingly, it is also not possible to remove all of the burr. If at all, the machine can be successful for removing burrs only with constant burr thickness after the approximate force required for removal of the burr has been preset in each case.

Numerically-controlled grinding machines, in which the estimated workpiece contour is pre-programmed, no doubt have been used for removing burrs on castings as part of finishing operations. But if the actual workpiece is smaller than expected, the burr is not completely removed. Conversely, if the actual workpiece is larger than expected, too much of the casting material may be removed, wasting grinding time and possibly damaging a smooth finish on part of the casting. Dimensions of castings generally are quite variable due to different shrinking in the cooling process and core displacement and consequently numerical control is only a partial solution to the problem.

The present invention detects the actual contour of the workpiece by sensing a sharp increase in the load on the grinding wheel as the grinding wheel is advanced inward into the work at a generally constant rate. This is contrary to prior art methods in which the load on a grinding wheel or rotary saw has been monitored or compared to a predetermined threshold in order to maximize cutting efficiency by controlling the feed of the grinding wheel into the workpiece in order to maintain the load on the grinding wheel at a constant and maximum value.

Muller, Great Britain Pat. No. 782,432 issued Sept. 4, 1957, for example, switches off a rapid idle transverse feed when a load is detected indicating that the grinding wheel comes into contact with the workpiece, and the grinding feed is automatically switched off and on in response to whether the load on the grinding wheel is greater or less than a preset threshold, the threshold being reached when the load on the grinding wheel becomes too great for continuous grinding. The load thresholds are detected by an ammeter activating switches at predetermined grinding motor current levels.

Lenning U.S. Pat. No. 3,589,077 issued June 29, 1971 discloses that a feedback control system for maintaining the grinding load at a constant value gives improved results especially for rotating workpieces if a peak detector selects the maximum motor current or power per revolution for comparison to a predetermined reference, so that peaks due to an out-of-round workpiece do not cause excessive force on the wheel. Lenning also switches the reference force to a lower reference value when the workpiece is reduced by the grinding wheel to a predetermined size.

Miyazawa et al. U.S. Pat. No. 4,075,792 issued Feb. 28, 1978 discloses a feedback control system for grinding the surfaces of a generally flat workpiece while maintaining a constant stock removal throughout the entire grinding process regardless of varying surface inclinations. The inward feed is controlled by the comparison of the load current, after low-pass filtering, to a predetermined current threshold and the transverse feed is controlled at a constant value less the outward velocity of the inward feed, so that the transverse feed velocity decreases for increasing inclinations tending to keep the stock removal per unit surface area constant.

Schreiber U.S. Pat. No. 4,075,792 issued Feb. 28, 1978 and Demers et al. U.S. Pat. No. 4,228,782 are further examples of feedback control systems controlling infeed to maintain load resistance at a maximum constant value.

Uhtenwoldt U.S. Pat. No. 4,193,227 issued Mar. 18, 1980 discloses a feedback control system sensing load resistance for grinding a workpiece with diverse grindability characteristics. The system has multiple load thresholds corresponding to the optimum loads for grinding soft and hard material layers in the workpiece, and at any given time the system is in a "soft" or "hard" grinding state in which the infeed is controlled to maintain the load resistance approximately equal to a low or high threshold, respectively. The system switches from the "soft" state to the "hard" state when the high threshold is exceeded, presumably within the response time of the feedback loop; conversely, the system switches from the "hard" state to the "soft" state when the load falls below the low threshold, also presumably within the response time of the feedback loop.

The present invention is distinguished from the prior art above since the present invention is not a feedback control system maintaining a load resistance at a relatively constant, preset value. The infeed is maintained at a relatively constant predetermined magnitude, but the direction of the feed oscillates inward and outward from the workpiece. The grinding wheel is always retracted outward from the workpiece for a substantial delay time after the grinding wheel grinds into the workpiece contour so that the surface of the grinding wheel oscillates with a substantial displacement about the interface between the burr or fin and the workpiece contour. During this delay time the workpiece is moved transversely. Contrary to the system disclosed by Miyazawa, the rib or fin on the workpiece is entirely ground off down to the workpiece contour regardless of the fact that the required stock removal of the burr or fin is not constant. Moreover, unlike the system disclosed by Chijiiwa et al., the present invention tracks a varying contour workpiece having surface inclinations and surface declinations.

The preferred embodiment of the present invention, which uses a series differentiation in the control loop, illustrates the striking difference between the present invention and the prior art feedback control systems. A differentiation as a series element in a control loop is known to lead to instability and hence oscillations. The present invention, however, uses controlled oscillations to achieve the unexpected result that a rib or fin may be ground off down to the workpiece contour despite variations in rib or fin outward extent from the workpiece surface contour and hence varying stock removal per unit of surface area. The use of a series differentiator in the control loop, moreover, permits the automatic removal of ribs or fins with varying engagement lengths, since the surface edge of the interface between the rib or fin and the workpiece contour is tracked by the control loop rather than the bulk material interface between the fin and the workpiece.

SUMMARY OF THE INVENTION

The general aim of the invention is to provide a grinding machine that automatically removes a burr or fin by tracking the contour of the workpiece.

It is also an objective of the invention to provide a means of detecting the contour of the workpiece by the engagement of the grinding wheel with workpiece as the burr or fin is removed since the burr or fin and grinding wheel itself would otherwise interfere with other means of detecting and measuring the workpiece contour.

Moreover, it is an object of this invention to provide a grinding machine for removal of burrs or fins from castings having a high metal removing capacity and having a stable, vibration-free, robust construction.

Furthermore, it is an objective of the invention to provide an automatic grinding machine that need not be programmed with the workpiece contour, so as to be economical when used for small batches.

In accordance with the present invention, a grinding machine is provided with at least two controllable, motorized feeds for positioning and moving the grinding wheel with respect to the workpiece. One motorized feed engages the grinding wheel into the workpiece in the radial direction with generally constant velocity, thus grinding into the burr or fin. As this is done, the circumferential force or torque on the grinding wheel is measured. Completion of the grinding of the burr or fin and engagement of the grinder is detected by the coincident increase in circumferential force, caused by the increase in contact area between the grinding wheel and the workpiece.

The circumferential force or torque is electronically measured and processed to remove noise and constant factors and the portion of the signal representing the torque information is compared to expected values to arrive at a decision whether the burr or fin has been completely ground away. Various electronic means for sensing circumferential force or torque may be used, including strain gauges and circuits for measuring the power consumed by the grinding wheel motor. Also, electronic circuits of increasing complexity are provided for processing the electrical signal representing circumferential force or torque to accommodate workpieces of increasing complexity and requiring increasingly high tolerances. The decision whether grinding has been completed may be made by comparing the circumferential force signal to a fixed threshold, or by comparing the rate of change of the circumferential torque with respect to time or with respect to the grinder feed velocity to a fixed threshold. The threshold may further be inhibited after the decision is made, for a fixed time delay or for a time dependent on the acceleration or rate of change of the circumferential torque and sensed by requiring the signal to drop below a second, lower preset threshold.

After the burr or fin is ground away and the engagement of the grinder with the workpiece is detected, the direction of the grinder feed is reversed in order to move the grinding wheel away from the workpiece to "nibble" away at successive portions of the burr or fin. A second or third motorized feed is then used to move the workpiece in a direction perpendicular with respect to the radial direction of the grinder. This movement may be indexed to the grinder feed, pulsed after the grinder wheel has disengaged itself from the workpiece, or the movement may be more or less continuous, of constant velocity or decreasing in velocity when the time for or distance traveled when grinding into the burr or fin increases. For complex work pieces, the general pattern of the movement of the grinder across the workpiece may be pre-programmed, including factors at each position on the surface of the workpiece to account for detailed relief and thus to increase the time for retraction of the grinder and decrease the velocity of movement of the grinder across the workpiece at these points. In other words, a numerically controlled machine tool grinder may be adapted according to the invention to more accurately track the surface of the workpiece by replacing its estimate of the surface position with the position actually detected based on monitoring the circumferential force on the grinding wheel.

DESCRIPTION OF THE PREFERRED EMBODIMENT

Figures 1, 2:
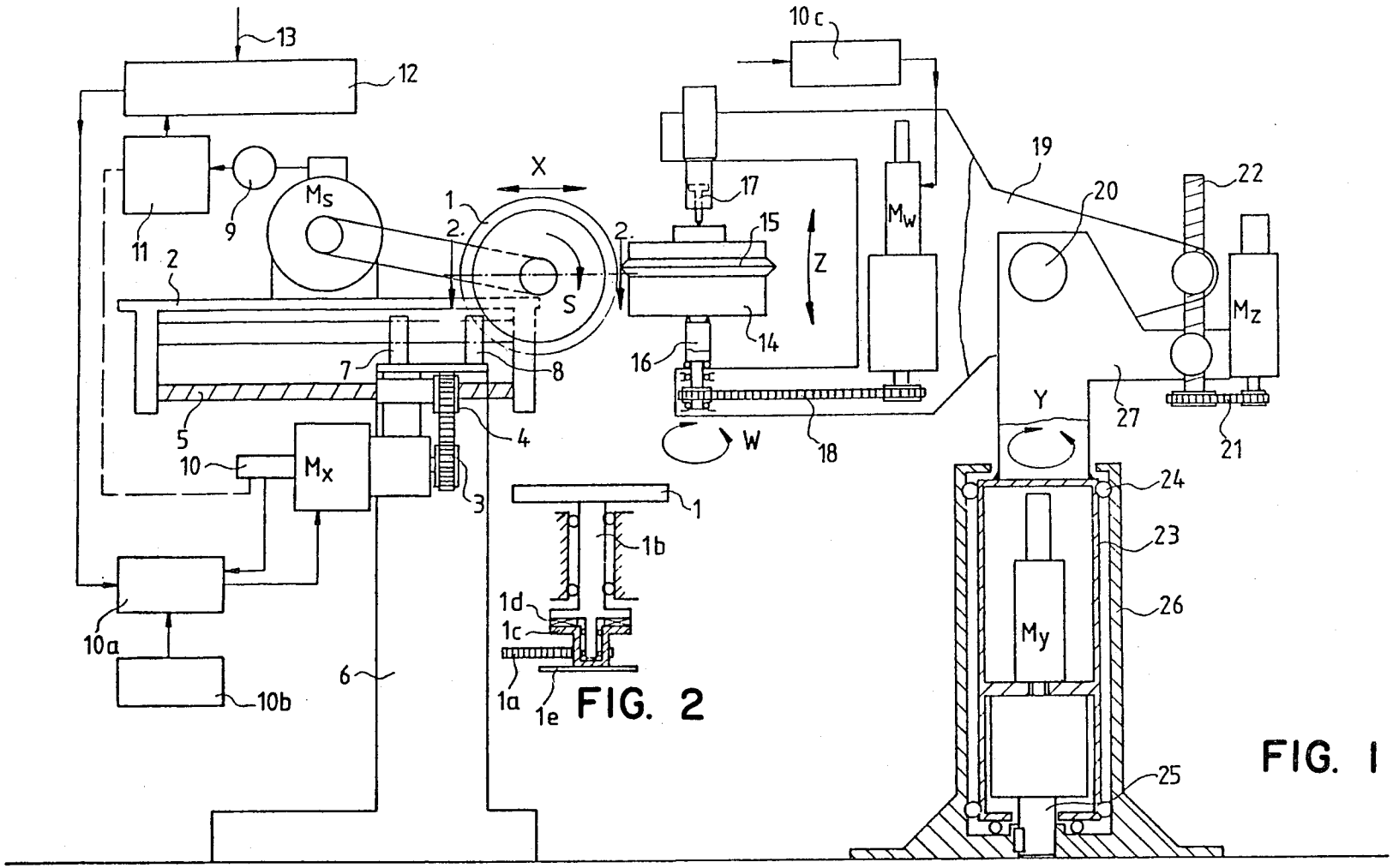
FIG. 1 shows an elevation of the grinding machine, partially as a sectional view.
FIG. 2 is a section along the line 2—2 in FIG. 1.

Turning now to the drawings, FIG. 1 shows a grinding wheel 1 with angular velocity S driven by a motor Ms and mounted on a grinding carriage 2. References to a grinding wheel herein contemplate any rotary machining means such as an abrasive wheel, rotary saw, rotary file, or milling tool. The grinding carriage 2 is slidably mounted via bearing blocks 7, 8 onto a fixed frame 6, with travel permitted in a direction designated as the X direction. Displacement in the X direction is controlled by a threaded spindle 5 axially aligned in the X direction, fitted with an axially fixed nut 4 driven by a motor Mx via a serrated belt drive 3.

The workpiece 14 with the casting burr 15 to be removed is clamped between a mandrel 16 and a hydraulic clamp 17 and made to rotate with angular velocity in the W direction by a motor Mw via a belt drive 18. The workpiece 14 is held by the clamp 17 in a frame 19, which can be swivelled around a pin 20 in the Z direction. Swivelling is preferable to a straight guide in the Z direction since rotary bearings are easily sealed from dirt. The swivelling is achieved by a further motor Mz via a serrated belt drive 21 and threaded spindle 22. The frame 19 can also be rotated in the Y direction by a motor My, which is flange-mounted on a rotary body 23 mounted in anti-friction bearings 24. The gear output shaft 25 of motor My is firmly connected to the casing of the workpiece clamping unit 26. The pin 20 is mounted on a holder 27, which is firmly connected to the rotary body 23.

The section in FIG. 2 shows in schematic form how the grinding wheel 1 can be disconnected from the drive 1*a* to the motor Ms. For this purpose the shafts 1*b* and the sleeve 1*c*, to which the drive 1*a* is trasmitted, can be disconnected from each other by operating a wheel coupling 1*d* so that only the smaller grinding wheel 1*e* is driven. Thus the type of grinding wheel can be adapted to the shape and size of the burr and the workpiece contour, and sensitive control of the grinding is possible since the inertial mass of the other wheel 1 is disconnected.

Figure 5:
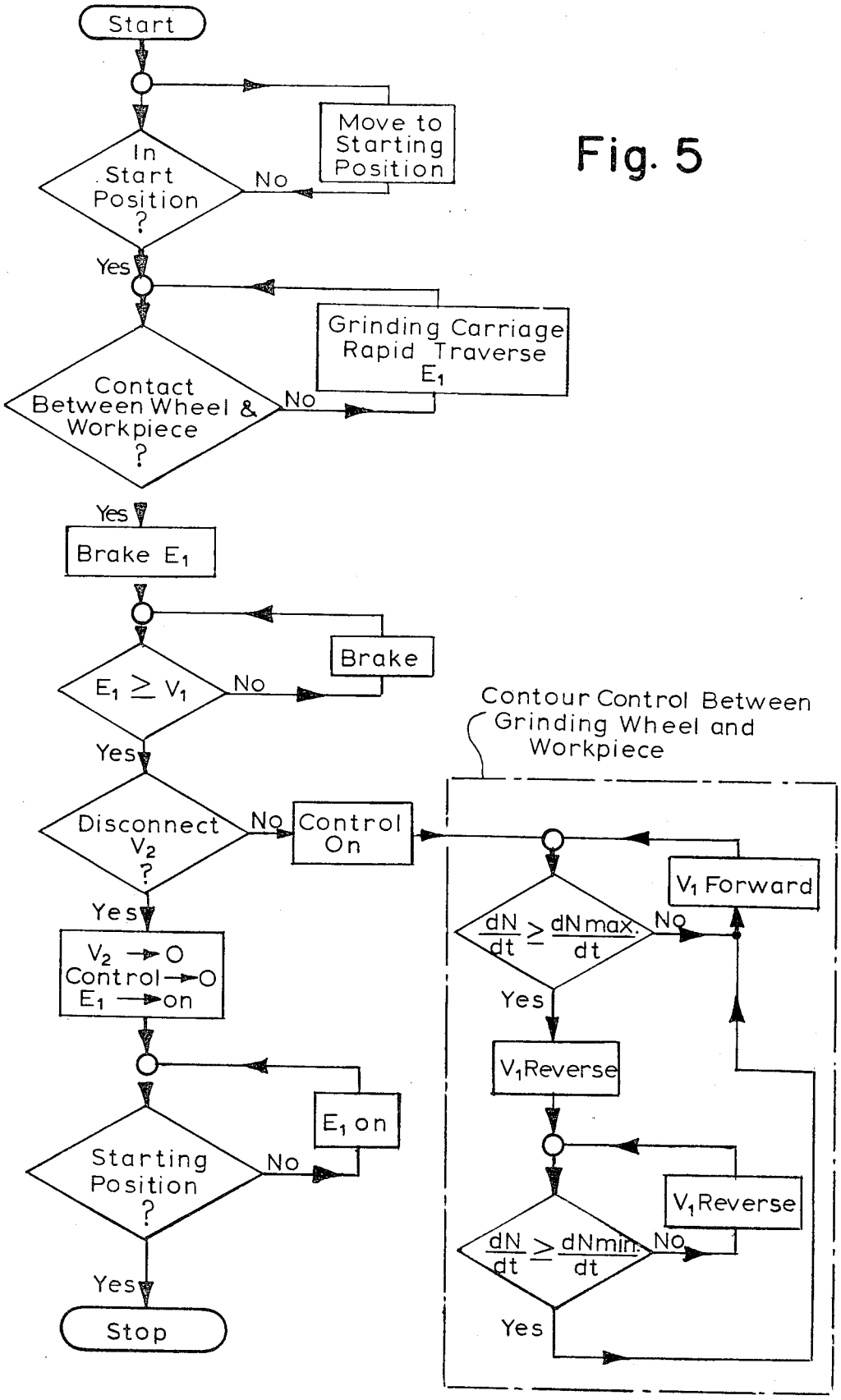
FIG. 5 is a flow diagram of the control unit in the block diagram of FIG. 4.

Operation of the grinding machine first requires alignment of workpiece 14 with the grinding wheel 1 by appropriate electrical inputs to motors Mz and My. The burr 15 on the workpiece 14 is positioned tangentially to the grinding wheel 1. This may be done manually or pursuant to numerical control, as in any numerically controlled machine tool. As shown in FIG. 5, this is the first step in the flow diagram of the machine control procedure. Next, with the grinding wheel motor Ms running, the grinder feed motor Mx is activated to rapidly engage the grinding wheel 1 with the edge of the burr 15 on the workpiece 14. This is done by turning off or braking the grinder feed motor Mx when carriage 2 travel reaches a predetermined point or when the grinding wheel 1 is in close proximity with the workpiece 14 as determined by limit switches, as is done with any numerically controlled machine tool to bring the tool in close contact with the workpiece, or when contact is detected by an increase of torque to the wheel 1 or current or power to the grinder motor Ms.

At this point the control of the grinding process is governed by a feedback control process of contour control between the grinding wheel 1 and the workpiece 14 in which the contour of the workpiece 14 is sensed by monitoring circumferential force or torque on the grinding wheel 1 resulting in control signals driving the grinder feed motor Mx and the workpiece rotation motor Mw. Motor Mw advances the burr 15 along its longitudinal direction with respect to grinding wheel 1 contact, while the motor Mx is driven in alternating directions to move the grinding wheel 1 into and away from the workpiece 14 to "nibble" away at the burr 15.

As shown in FIG. 1, the circumferential force Pu to be applied to the grinding wheel 1 or the torque or the power to the grinder motor Ms is measured by measuring equipment 9. The voltage applied to the electric motor Ms and the consumed current, for example, are measured here. The resulting circumferential force or torque signal is fed to an electronic circuit 11 that may also receive a signal from a tachogenerator 10 monitoring the grinder feed motor Mx speed and thus the rate of feed $V_1$. The connection shown by a broken line indicates that this is an optional connection. The electronic circuit 11 processes the circumferential force or torque signal and presents it to a comparator circuit 12 where it is compared in a known way with a predetermined threshold value 13. When the threshold value 13 is achieved or exceeded, the grinder feed motor Mx rotation is reversed by motor controller 10*a*. The motor controller 10*a* also accepts inputs from the tachogenerator 10 and a required value transmitter 10*b* set at a predetermined rate so that the $V_1$ feed rate may be maintained at a constant value by comparing the tachogenerator 10 signal with the required value transmitter 10*b* signal and energizing the grinder feed motor Mx with the difference. Preferably the grinder feed motor Mx is a low-inertia, fast response permanent magnet armature motor, and in conjunction with tachogenerator 10 and control circuit 10*a* and 10*b* it runs at generally constant speed when the grinding wheel 1 is grinding into the burr 15 of the workpiece 14. An associated control circuit 10*c* concurrently drives the workpiece rotation motor My for advancing the grinding wheel 1 along the length of the burr 15.

Figure 3A:
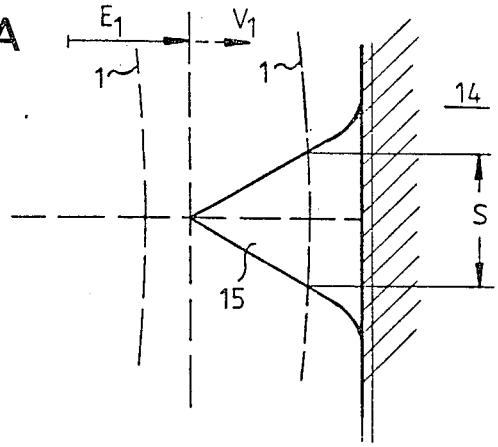
FIGS. 3A, 3B, 3C and 3D are diagrams showing detection of the workpiece contour.
Figure 3B:
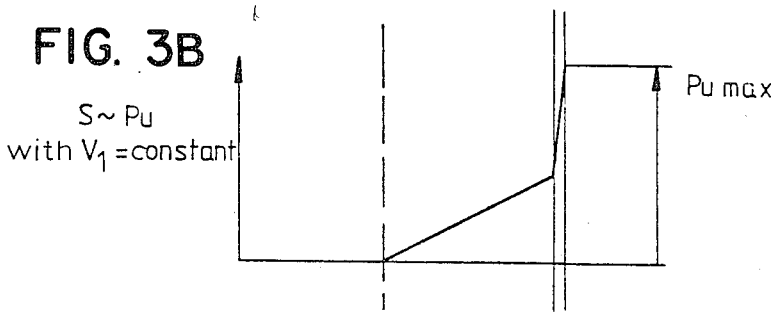

The success of the contour control process is based on the ability to accurately and reliably detect the contour of the workpiece 14 even though grinding is occurring at the same time. In accordance with the invention, the contour is inferred from the assumption that the circumferential force Pu occurring on the grinding wheel 1 is approximately proportional to the wheel engagement length S and the feed rate $V_1$. Referring to FIG. 3A, a cross-section of the burr 15 is shown, with the grinder wheel 1 axis and the burr 15 longitudinal axis oriented perpendicular to the plane of the paper. This is the cross-section cut by the grinding wheel 1 advancing in the X direction into the workpiece 14. The grinding wheel 1 is first advanced at a rapid velocity in the X direction of $E_1$. The curved dashed line 1 represents the circumference of the wheel 1. At approximate contact with the burr, the contour control process is initiated and the grinding wheel 1 is further advanced but at a slower and relatively constant velocity $V_1$. Experimentally it is observed that the circumferential force Pu on the grinding wheel 1, as shown in FIG. 3B, is directly proportional to the product of the wheel engagement length S and the feed rate $V_1$, and is thus a measure of the contour of the finished workpiece 14. The circumferential force Pu is also directly proportional to the grinder motor Ms torque divided by the grinder wheel 1 radius, which in turn is approximately proportional to the grinder motor Ms current or more accurately proportional to the power consumed by the grinder motor Ms at constant rotational velocity.

Figure 6:
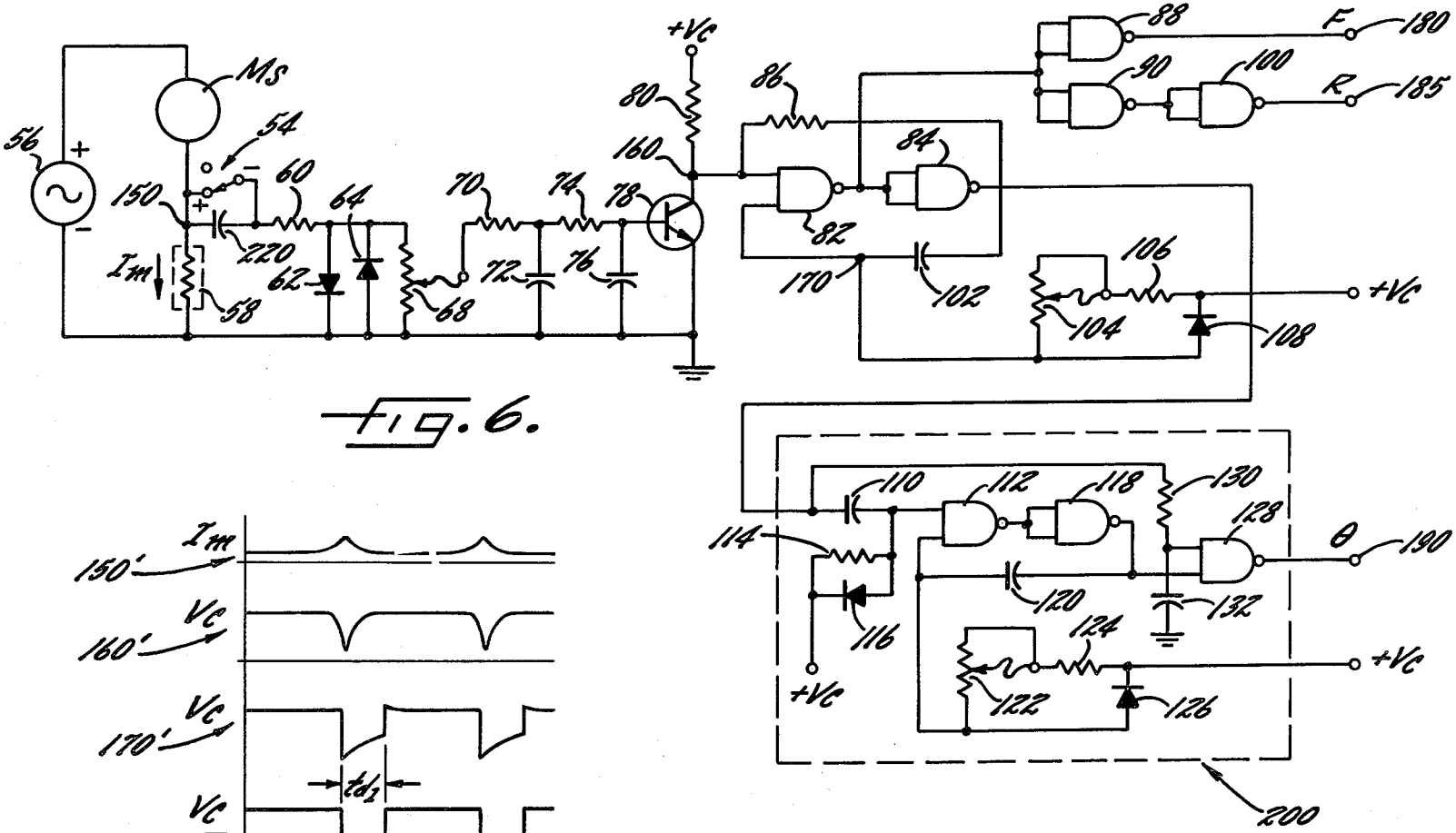
FIG. 6 is a circuit diagram of a simplified embodiment of the control circuitry, having a fixed torque threshold.

FIG. 6 shows a simplified embodiment of the invention which illustrates the signal path in the contour control feedback loop. A DC grinder motor Ms is driven by a constant voltage supply 56 through a current sensing shunt resistance 58, selected so that a maximum of about 0.5 volts appear across the shunt resistance 58. The voltage drop across the shunt 58, of course, is a measure of the current Im drawn by the grinder motor Ms and is thus a measure of the cirumferential force or torque on the grinding wheel 1. Assuming switch 54 is closed, this voltage drop is processed by a noise limiter comprising a series resistor 60 and reverse-polarity silicon diodes 62 and 64, which limit noise impulses to about ±0.6 volts and protect the rest of the circuit components from large transients that may be present in the voltage source 56 or generated across the motor Ms terminals due, for example, to commutator arcing. A potentiometer 68 is provided for setting the threshold level. Noise impulses are further attenuated by an RC lowpass filter comprising resistors 70, 74 and capacitors 72, 76. The RC time constant should be about 5 ms to provide good noise immunity without significantly impairing response time of the threshold detection. The values for the resistors are set so that the signal is not appreciably attenuated, and respresentative values are 470 ohms for R60, 4.7K ohms for R68, and 10K ohms for R70 and R74. A 5 ms time constant then requires about 0.5 uf for C72 and C76. An npn germanium transistor 78 is used as an amplifying and threshold reference element. A pnp transistor could be used if the polarities of all the other polar components are reversed, including changing NAND logic gates to NOR gates in accordance with DeMorgan's theorem. A silicon transistor could also be used but this would require replacing each of the noise limiter diodes 62 and 64 with three silicon diodes and would require the shunt resistance 58 to be increased by a factor of three to compensate for the higher base-emitter voltage drop of 0.6 volts instead of the 0.2 volts for gamanium transistors. The collector current of the transistor 78 is an exponential function of the base-emitter voltage, and a few milliamperes is reached at a base-emitter voltage of 0.2 volts. The collector current is sensed by load resistor 80. For a supply voltage +Vc of +10 volts, for example, a 4.7K ohm resistance will trigger the logic circuitry threshold of one-half supply voltage for a collector current of 1 ma. Preferably complementary MOS, or CMOS, logic components having high input impedance are used. NAND gates 82, 84 in conjunction with a 47K ohm feedback resistor comprise a Schmitt trigger for generating a clean binary logic signal which is buffered by gates 88, 90, and 100 to select the polarity of the field windings in the grinder feed motor Mx for driving the grinding wheel 1 forward into the workpiece 14 or reversing the motor to pull the grinding wheel 1 out of the workpiece 14. Assuming that the circumferential force Pu, torque, and thus motor current Im are well below the threshold set by the potentiometer R68 with respect to the inherent reference threshold of the base-emitter drop required for turning on transistor 78, the grinding wheel 1 advances forward. When the threshold is exceeded, the transistor 78 turns on, so that the output of gate 82 goes from low to high, and thus gates 84, 88, and 90 go from high to low, and gate 100 goes from low to high. Resistor 86 pulls down the input of gate 82 still further so that these changes in logic states occur very rapidly. Gate 82 is provided with a second input for accommodating a feedback capacitor 102 used to inhibit consequent logic changes for a predetermined delay time td1 so that the grinder feed motor Mx may have sufficient time to respond to the reverse in direction and disengage the grinder wheel 1 from the workpiece 14. The gate 82 is inhibited for the time required for the capacitor 102 to charge up through delay-time potentiometer 104 and resistor 106 to a value of ½ supply, whereupon gate 82 can be enabled and gate 84 may respond to quickly discharge the capacitor 102 through diode 108. Diode 108 is actually an inherent input protection diode inside logic gate 82, but it is shown in FIG. 6 as a separate element to aid understanding of circuit operation.

Figure 7:
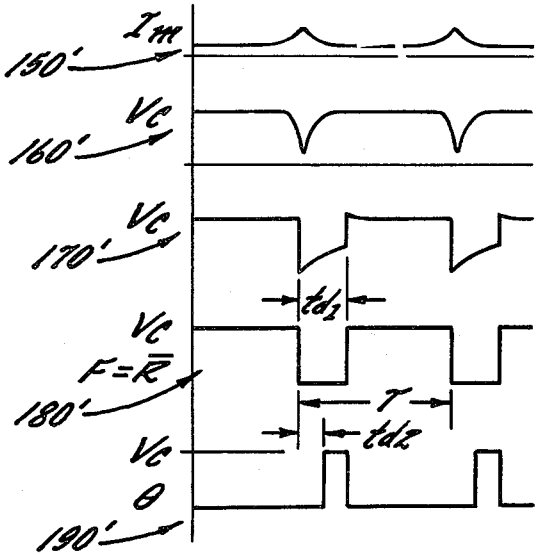
FIG. 7 is a timing diagram corresponding to the circuit in FIG. 6.

The inhibiting and time delay function of capacitor 102 is illustrated in the timing diagram of FIG. 7. When the shunt 58 current Im generally designated 150' sensed at node 150 approaches the threshold value, the transistor 78 collector voltage generally designated 160' measured at node 160 abruptly decreases from the supply voltage +Vc causing gates 82 and 84 to trigger and forcing the capacitor 102 voltage generally designated 170' measured at node 170 to abruptly drop from +Vc to ground. This voltage rises at a time constant set by the product of C102 and the sum of R106 plus the setting of adjustable potentiometer 104. Representative values are 1M ohm for R104, 1 mf for C102, and 47K for R106 to yield a time delay td1 adjustable from about 50 ms to 1 sec.

With reference to the grinder feed polarity signal generally designated 180' and appearing at node 180, when the signal is high, at +Vc, the grinding wheel 1 is advancing, and when it is low, the grinding wheel 1 is retracting from the workpiece 14. The workpiece 14 could also be moved at a constant velocity $V_2$, preferably about just as fast as the grinding wheel 1 is advancing, across the wheel 1 perpendicular to its radius. The workpiece rotation motor Mw was provided for this purpose. It should be noted, however, that the period T required for the grinding wheel 1 to advance forward and back again is an indication of the difficulty to grind into the workpiece 14 and of the amount of material removed by the grinding process. Thus it is advantageous to reduce the velocity $V_2$ driven by the workpiece rotation motor Mw in proportion to T, and, for example, the motor Mw should have zero velocity if T becomes infinite. But if T is on the order of td1, then $V_2$ may achieve the desired maximum of about $V_1$. Mathematically the optimum $V_2$ may be expressed as:

$$V_2\,\text{opt} = C\left[V_1 - \frac{V_1(T - td1)}{T}\right] \qquad \text{Equation 1.}$$

where C is a constant of proportionality. Incidentally, $V_2$ opt as defined in Equation 1 is proportional to the average value of the reverse signal R appearing on node 185. If the motor Mw has high inertial mass, then it could be energized directly with the R signal. The R signal could, for example, enable a four quandrant regulator or conventional triac controller interfacing the motor Mw with the power lines. If the motor Mw has low inertia, and thus may respond quickly, it is desirable to delay energizing it a short period of time td2 during which the grinding wheel 1 is retracting from the workpiece 14. In effect the workpiece rotation motor Mw is indexed in synchronism with the grinder feed motor Mx to successively "nibble" away at the burr 15 on the workpiece 14. Variable control of td2 also reduces the average value of the workpiece rotation motor Mw control signal $\theta$, generally designated 190' in FIG. 7, and is a method of controlling C and thus the velocity $V_2$.

The workpiece rotation motor Mw control signal $\theta$ appears at node 190 and is the output of a time delay circuit generally designated 200. A copy of the F signal is available on the output of gate 84 and its falling edge is sensed by a highpass network consisting of capacitor 110, resistor 114, and inherent gate input protection diode 116. The RC time constant should be greater than several gate delays, and representative values are R114 of 10K and C110 of 1,000 pf. NAND gates 112 and 118 in conjunction with capacitor 120, potentiometer 122, resistor 124, and inherent gate input protection diode 126 function as a one-shot timer that operates analogous as the timer formed by gates 82 and 84. The component values should be the same: C120=C102, R122=R104, R124=R106. The logically high pulse output of gate 118, of time delay td2 set by potentiometer 122, is used to inhibit gate 120. Gate 120 otherwise passes and inverts the F signal, generating the desired $\theta$ signal 190'. Resistor 130 and capacitor 132 serve to compensate for the delay of gates 112 and 118, and thus should have a time constant greater than a few gate delays. Representative values are R=10K and C=1000 pf.

Equation 1 is based on the assumption that $V_1$ is constant over a period of the F signal 180'. Actually, a better measure of the numerator $V_1$(T-td1) is the actual distance traveled by the grinder carriage 2 over a period T, mathematically:

$$V_2\,\text{opt} = C\left[V_1 - \frac{1}{T}\int_O^T /V_1/dt\right] \approx C\left[V_1 - \frac{1}{T}\int_O^{T-td1} V_1 dt\right] \qquad \text{Equation 2.}$$

The factor $$-\frac{1}{T}\int_O^T /V_1/dt \text{ or } -\frac{1}{T}\int_O^{T-td1} V_1 dt$$

may be obtained with high resolution from the average value of the output of the tachogenerator 10 on the grinder feed motor Mx shaft if the tachogenerator 10 is not responsive to direction, or after blocking negative tach pulses with a diode if the pulses are bipolar, indicating displacement rather than distance. The tachogenerator signal has the same form as the $\theta$ signal 190' except that its repetition rate is much higher, thus providing higher resolution for control of $V_2$.

The simplified embodiment in FIG. 6 detects the contour of the workpiece 14 by measuring the absolute value of the circumferential force Pu when the switch 54 is closed. From a signal processing point of view, the threshold detector should respond to the occurrence of the corner or bend in the function of circumferential force Pu on the grinding wheel 1 with respect to the X coordinate of radial engagement, as shown in FIG. 3B. It is this point that is coincident with the contour of the workpiece 14. Also, this point is relatively independent of the size of the casting burr 15, the absolute value of the circumferential force Pu, and the slope of the casting burr 15. This suggests that the edge is characterized by its high rate of curvature and slope, so that the information in the Pu(X) signal is located at "high" rather than "low" spatial frequencies.

According to a signal detection theory, optimal detection of a signal is obtained by processing the signal with a matched filter, which should have a frequency response matching the frequencies of the signal to be detected. Optimally the filter may be realized as a correlator. The frequencies in the corner or bend in the Pu(X) function may be obtained by a Laplace transform or experimentally with a spectrum analyzer. A temporal signal for analysis or processing may be obtained since $X=V_1t$ and thus:

$$Pu(X)=Pu(V_1t) \qquad \text{Equation 3.}$$

It is evident that the spectrum contains more high frequencies than low frequencies, and thus the first step in signal detection should be to emphasize the high frequencies by differentiating the signal, thus rejecting the absolute value or DC component of the signal from the gradient or time derivative of Pu:

$$\frac{d[Pu(X) + C]}{dx} = \frac{dPu(X)}{dx} \qquad \text{Equation 4.}$$

And for $X=V_1t$ where $V_1$ is constant, $dx=V_1dt$ and:

$$\frac{dPu(X)}{dx} = \frac{dPu(V_1t)}{dx}\;\frac{1}{V_1}\;\frac{dx}{dt} = \frac{1}{V_1}\;\frac{dPu(V_1t)}{dt}$$

Figure 3C:
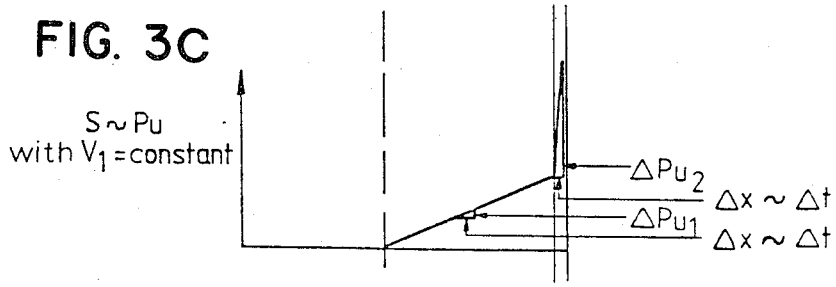
Figure 3D:
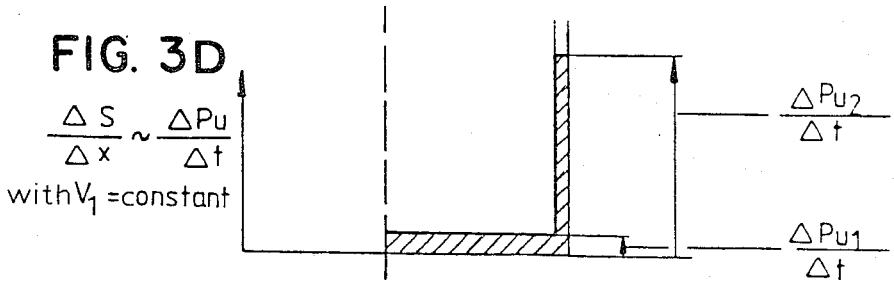

These equations are illustrated in FIG. 3C and FIG. 3D. The differentiated signal in FIG. 3D has emphasized the corner or bend into a pronounced leading edge. The leading edge may be used to trigger a threshold detector, resulting in earlier dection since it is unnecessary to allow the grinding wheel 1 to penetrate until the measured circumferential force Pu achieves a specific threshold value in absolute terms.

Referring to the simplified embodiment in FIG. 6, the circuit may be made responsive to the time rate of change in the torque of the grinder motor Ms by opening switch 54, thus adding a high-pass capacitor 220 in series with the detector input. The time constant of this capacitor 220 should correspond to the time constant of the low-pass filter capacitors 72, 76 so that the overall response is bandpass, in approximation of a matched filter for the expected edge signal. The filtered response should roll off at the high end since the signal to noise ratio increases at higher frequencies, and signal detection theory mandates that the optimal filter response should be inversely proportional to the signal to noise ratio at any given frequency. A representative value for C220 is 2 uf.

The simplified embodiment in FIG. 6 has several inherent disadvantages. A high input signal level is required, so that if a large grinder motor Ms is used the power consumed in the shunt resistor 58 would be prohibitive. The threshold level is also inherently set by the transistor 78 base-emitter drop which is highly temperature dependent. The typical method of curing these difficulties is to substitute operational amplifiers for transistors. Moreover, the circuit in FIG. 7 cannot respond very well to AC motor current and cannot discriminate between inductive power reflected by an AC motor from the power consumed, and is thus limited to DC grinder motor applications. These difficulties can be eliminated by synchronously detecting the AC motor current Im in phase with the motor voltage. Furthermore, the simplified embodiment provides a fixed dely time td1 for retraction of the grinding wheel 1 from the workpiece 14. Actually it is possible to provide a variable delay time which takes into account the position of the workpiece 14 contour by triggering the completion of retraction on a second, lower threshold. For this purpose $V_2$ is continuous and relatively constant over each carriage engagement and retraction cycle. Then even on retraction, the circumferential force Pu is somewhat responsive to the workpiece 14 contour, since there will still be grinding occurring, especially on the side of the grinding wheel 1 facing the advancing portion of the workpiece 14. The use of two thresholds for control between the grinding wheel 1 and workpiece 14 is summarized in the FIG. 5 flow diagram. After the grinding wheel 1 is first brought into contact with the burr 15 on the workpiece 14, two-point control is switched on to regulate the forward engagement of the grinding wheel 1 with the workpiece 14. The circumferential force Pu increases as engagement occurs. If a preset maximum gradient or time derivative is exceeded, the interface between the workpiece 14 contour and the burr 15 is detected and the forward feed is switched to a reverse feed. Reverse feed continues until the gradient or time derivative decreases below a preset minimum, signalling the optimum time to switch back to forward feed. This sequence is repeated until the entire burr 15 is ground off as detected, for example, by a cam switch on the mandrel 16 in the embodiment of FIG. 1.

Figure 8:
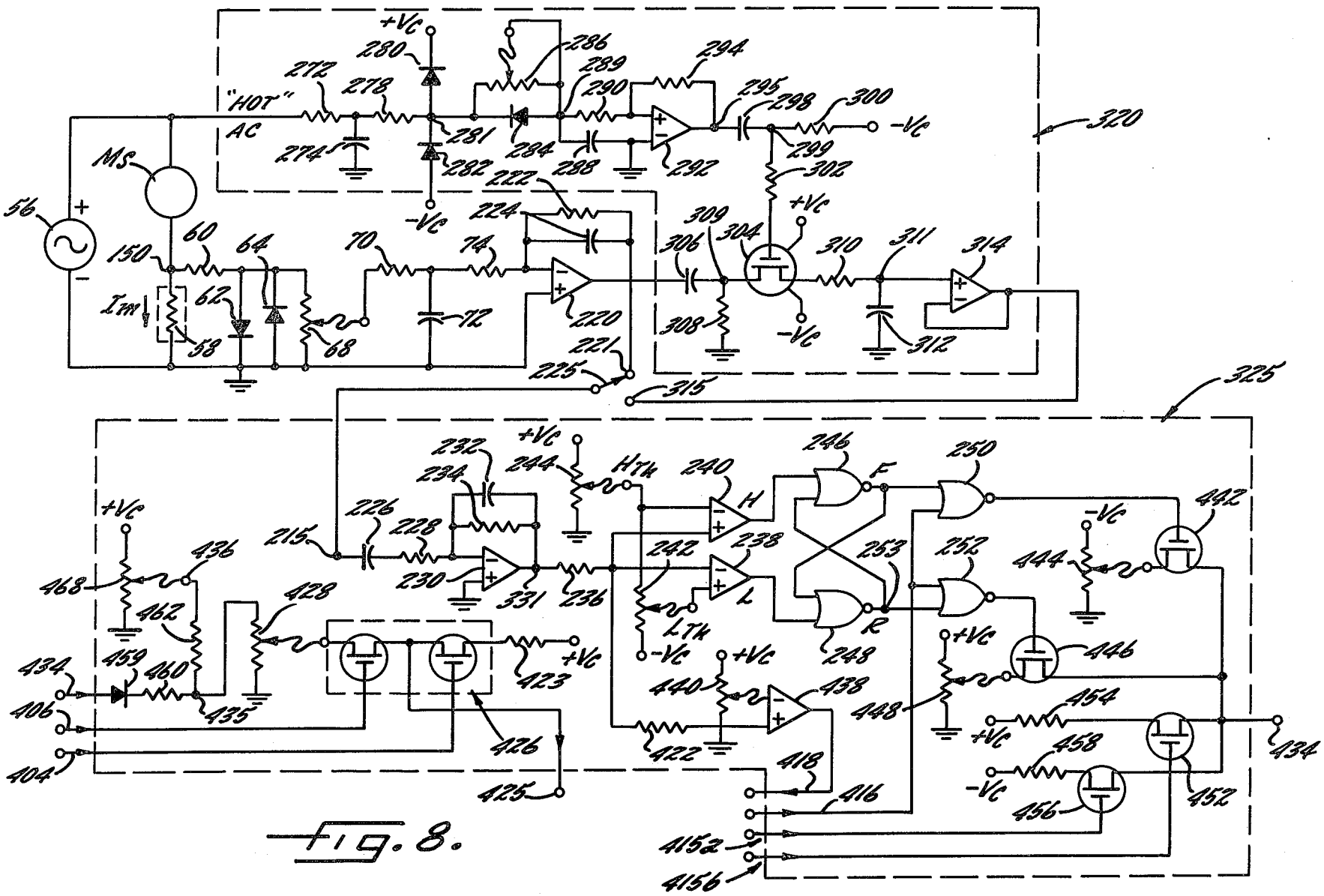
FIG. 8 is a circuit diagram illustrating means for detecting in-phase motor current, differentiating the torque signal, and comparing the time rate of change of torque to pre-set thresholds.

The improved electronic circuitry which may be used for components 9, 11, 12, and 13 of FIG. 1 is shown in FIG. 8. The transistor 78 is replaced by an operational amplifier 220 and gain setting feedback components, a resistor 222 and a capacitor 224. Representative component values are 470K for R222 and 0.01 uF for C224. If the supply 56 and grinder motor Ms are DC, the DC position of the toggle switch 225 selects terminal 221 and the output of op amp 220 is fed directly to node 215 and is differentiated by capacitor 226. The capacitor is part of a bandpass filter including resistor 228, op amp 230, and feedback components capacitor 232 and resistor 234. The response of this filter approximates the spectrum of the corner or bend in the Pu function. Representative component values are R234=220K, C232=0.02 uf, R228=100K, and C226=0.2 uf. The output of op amp 230 is fed via isolating resistor 236 to comparator op amps 240 and 238. Thresholds are adjusted by first setting potentiometer 244 for the high threshold and then setting potentiometer 242 for the low threshold. The outputs of the comparators are fed to a set-reset, or SR, flip-flop consisting of gates 246 and 248 which switch and hold the control signal for feed direction. Buffered outputs are provided by gates 250 and 252 for driving the motor controls for the grinder feed motor Mx.

Figure 9:
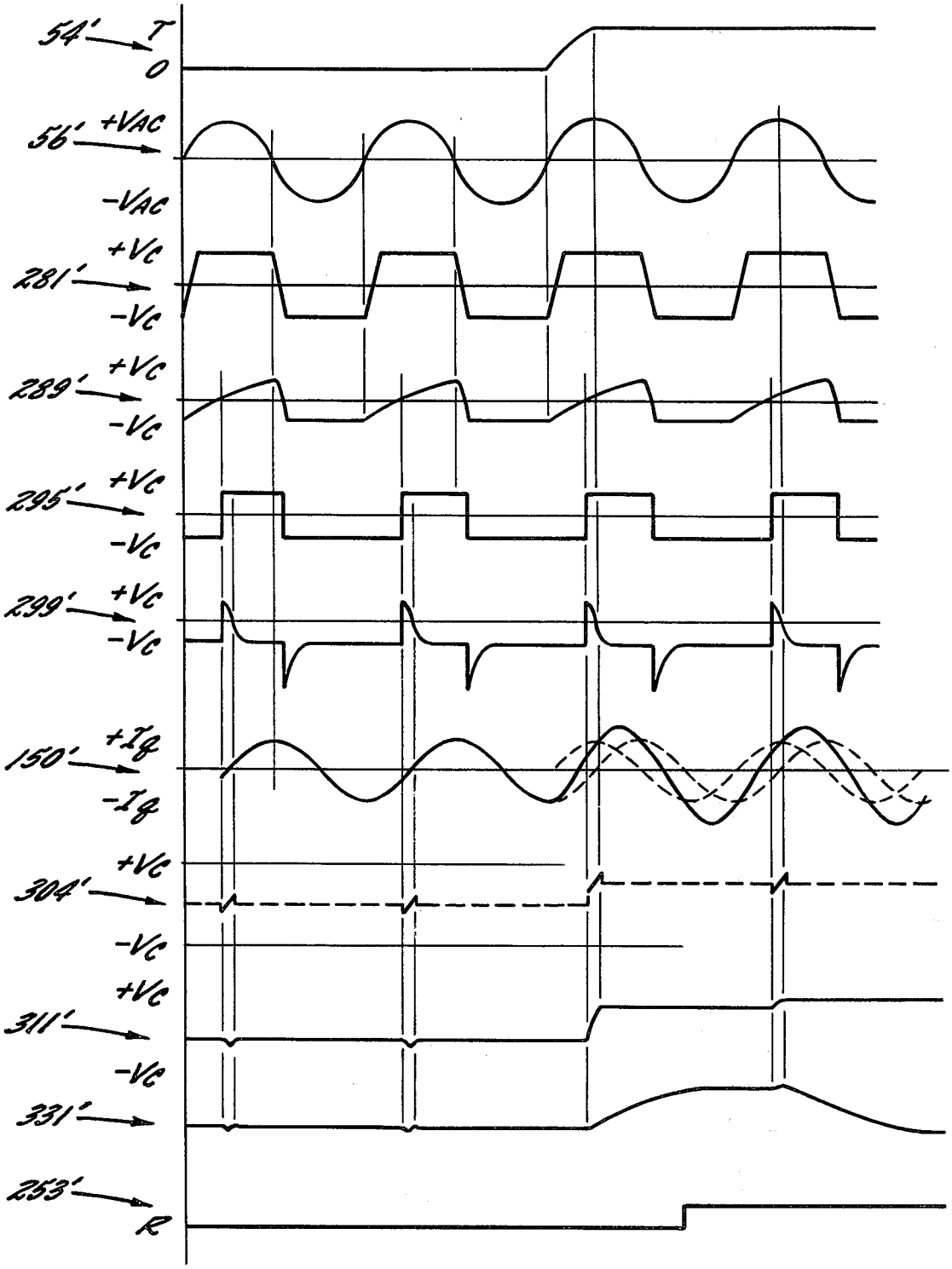
FIG. 9 is a timing diagram corresponding to the circuit in FIG. 8.

The improved circuit may be made responsive to AC power consumed by an inductive motor by adding a synchronous detector circuit generally designated 320 in FIG. 8. The corresponding timing diagram is shown in FIG. 9. The AC current 150' from node 150 into shunt 58 has a large inductive component that is 90° out of phase with the supply voltage 56' even though the torque on the grinder motor Ms is zero. The torque is, however, proportional to the in-phase AC current and may be detected by sampling the AC current at the 90° phase points on the supply voltage. For this purpose the supply voltage is low-pass filtered by resistor 272, capacitor 274 and resistor 278 and clamped to plus and minus supply +Vc, −Vc by diodes 280 and 282 to form a trapezoidal waveform 281' at node 281. Representative values are R272=R278=470K and C274=0.02 uf. The trapezoidal wave is converted to a ramp 289' appearing at node 289 by diode 289, integrating capacitor 288 and potentiometer 286 for adjusting the ramp slope and thus the sampling phase. Representative values are R286=1M and C=0.01 uf. The ramp is converted to a square wave 295', at node 295, with an adjustable leading edge by a Schmitt trigger comprising resistor 290, op amp 292 and feedback resistor 294. Representative values are R290=1M, R294=10M. The leading edge of the square wave 295' is converted to an enabling pulse 299' at node 299 by compacitor 298 and resistor 300. A current limiting resistor 302 is used to interface to the enable input of a CMOS transmission gate 304. Representative values are C298=0.01 uf, R300=47K, R302=47K. The transmission gate is AC coupled to the output of op amp 220 by capacitor 306 and resistor 308. Representative values are C306=4.7 uf, R308=68K. When the transmission gate 304 is enabled, the gate is conductive as illustrated in waveform 304' transferring charge through resistor 310 to holding capcitor 312. The synchronously detected AC current output appears as waveform 311' at node 311. Representative values are R310=4.7K, C312=0.02 uf. This signal is buffered by op amp follower 314, and after passing through the AC position of switch 315 selecting contact 315, and passing through the bandpass filter of op amp 230 it appears at node 331 as waveform 331', triggering the high threshold detector and generating reversing signal 253' at flip-flop output node 253.

Figure 10:
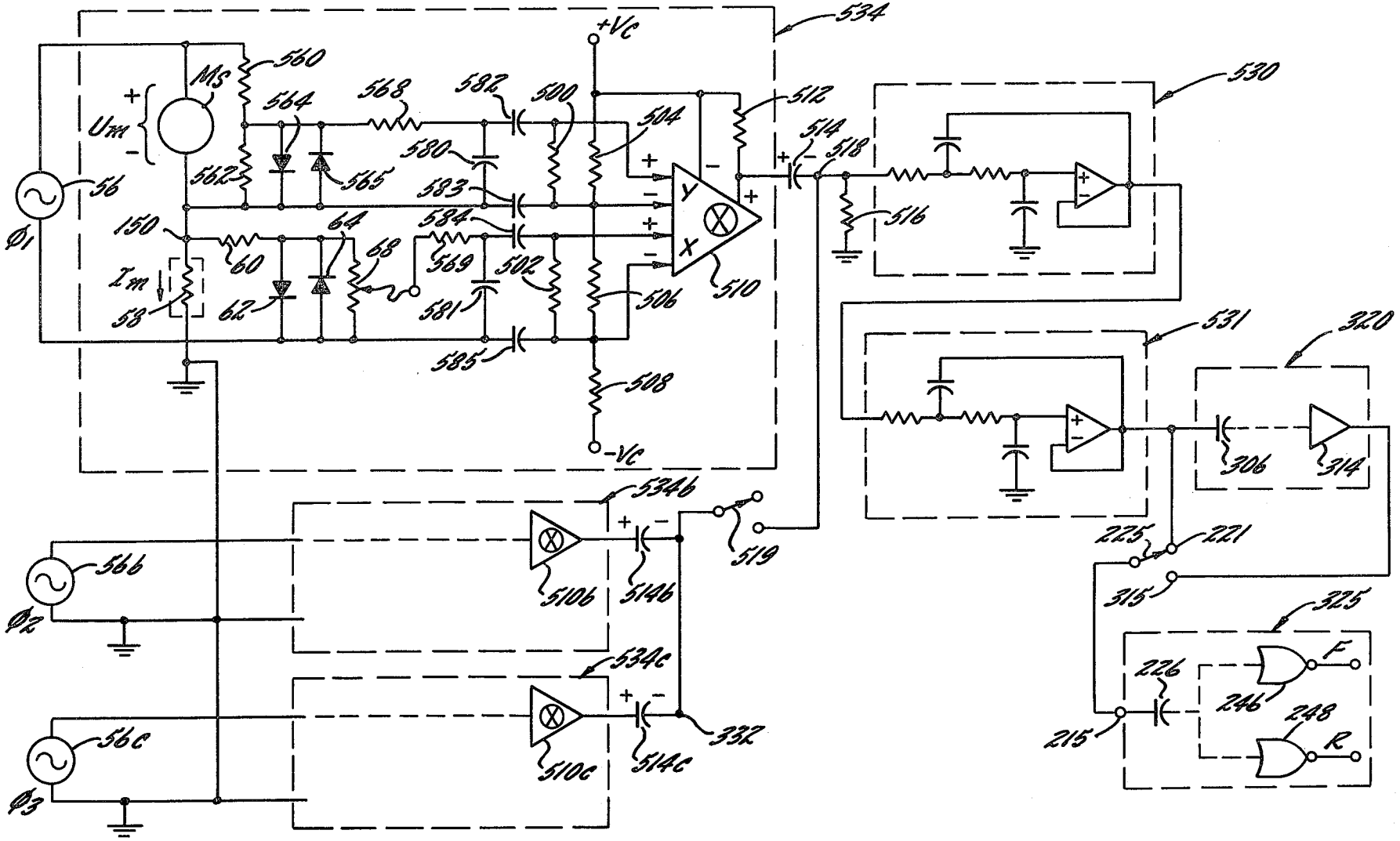
FIG. 10 is a circuit diagram illustrating the use of a four-quadrant multiplier for determining the AC power consumed by the grinder motor.

If it is desired to calculate the power consumed by the grinder motor Ms, additional circuit complexity is required in the form of a 4 quadrant multiplier, also known as a doubly-balanced mixer. As shown in FIG. 10 the multiplier 510 continuously multiplies the AC current signal Im generated across the shunt 58 by the voltage drop Um across the grinder motor Ms. The motor voltage Um is reduced to 100 mV levels by divider resistors 560 and 562; representative values are R206=1 M and R262=1 K. Diodes 564 and 566 provide noise limiting and input protection. Reistors 568 and 569 in conjunction with capacitors 580 and 581 filter out noise. Representative values are R=10K and C=0.05 uf. Capacitors 582, 583, 584 and 585 are coupling capacitors. R500 and 502 are bias resistors. Typical values are C=1.0 uf and R=33K. Resistors 504, 506 and 508 form a bias string. Typical values are R=10K. Biasing is shown for the elementary multiplier configuration of three differential transistor pairs; a linear IC data book may be consulted for improved commercial versions of this basic circuit component. The positive output of the multiplier 510 is fed to load resistor 512 and shifted back to ground level by blocking capacitor 514 and bias resistor 516. Typical values are R512=2.2K, C514=50 uf and R516=10K.

The output of the multiplier 310 contains a low frequency component which is the scalar product N=UmImCos $\phi$ of the phasors representing the voltage and current, and spurious products at twice the AC frequency, corresponding to 120 Hz for the representative component values. Imbalance and non-linearities of the multiplier 510 generate additional spurious signals at multiples of the AC frequency. Standard low-pass filter stages generally designated 530 and 531 are used to attenuate these frequencies R=56K and C=0.05 uf are representative values. The output of the last lowpass filter stage 531 is connected through switch 225 via closure of contact 221 to input node 215 to the differentiating capacitor 226 of the detector 325 further described in FIG. 8, or for additional filtering, the sampler 320 is switched in series with the lowpass filter 331 via closure of contact 315 of the switch 225 to input node 215. The sample and hold 320 functions as a sampling notch filter to remove spurious components of multiples of the AC frequency at the multiplier 510 output; however, the sampler imposes a time delay in measuring the power consumed by the motor Ms which is an inherent limitation when a single phase of AC is available for measurement since the power delivered by each phase individually is not continuous. If a polyphase induction or synchronous motor Ms is used, then the sum of the powers to all of the phases is approximately contant over a cycle. The circuit in FIG. 10 may accomodate more phases by adding a multiplier section generally designated 520 for each additional phase as shown in FIG. 10. Switch 519 is closed to add in the power signals produced by multiplier circuits **534*b* and 544*c* containing additional multipliers 510*b* and 510*c*, which are duplicates of the 534 circuit, and the power signals are summed through capacitors 514*b* and 514*c* which have the same values as capacitor 514. Three phase power is standard, and the Y configuration should be used as shown with a common power and signal ground connecting sources 56, 56*b*, and 56*c* for the three phases $\phi_1$, $\phi_2$, and $\phi_3$. Another method for obtaining a continuous measure of the circumferential force Pu on the grinder is to use a strain gauge on the grinder motor Ms shaft or motor mounts to measure torque directly, but unlike motor current, strain gauges are susceptible to responding to radial forces caused, for example, by grinder wheel 1** imbalance.

Figure 4:
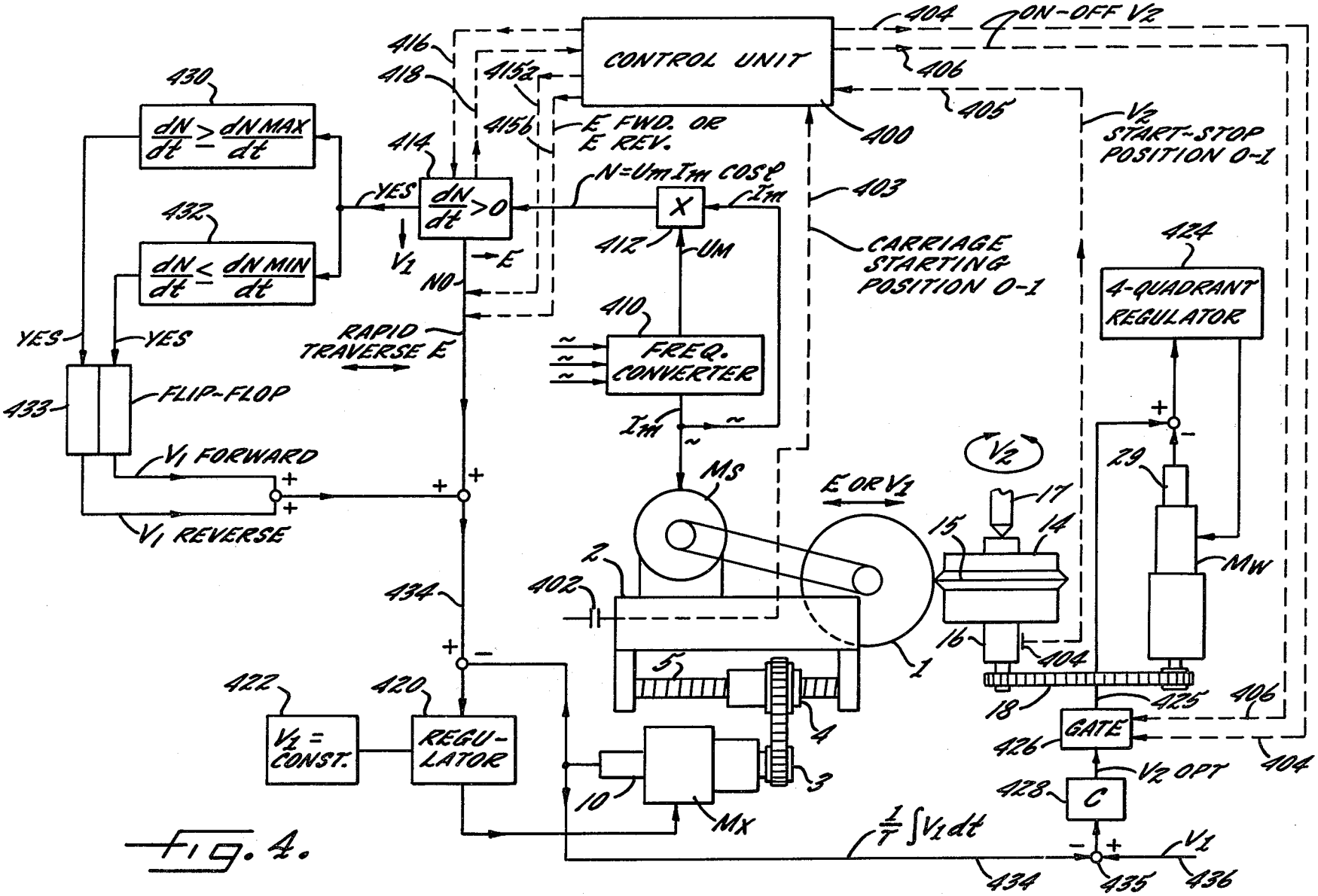
FIG. 4 is a detailed regulating and control block circuit diagram.

The complete control system employing two point control is summarized in the schematic diagram of FIG. 4. As in conventional numerically controlled machines, a control unit 400 contains a microprocessor and memory holding a set of instructions corresponding to the steps indicated in the flow chart of FIG. 5. A representative set of instructions is listed in Table I at the end of the specification. The control unit 400 accepts as inputs logic signals from limit switches and has various other connections indicated as broken lines. Limit switch 402 closes when the grinder carriage 2 is at the start position and trasmits the closure to the control unit 400 via input line 403 as a high signal or logical 1. Thus the control unit 400 may move the carriage 2 to this starting position by first testing whether switch 402 is closed, and if it is not, it may take control of the grinder feed motor Mx driving the carriage 2 by inhibiting other control inputs to the motor Mx regulator of conventional design, comprising reference 422, regulator 420, and tachogenerator 10, by outputing an inhibit signal on line 416. The control unit 400 then sends a reverse signal on line **415*b* for rapid transverse movement at rapid velocity E until switch 402 closes. Similarly, a cam-operated limit switch 404 on the workpiece mandrel 16 indicates a start-stop angular position to the control unit 400 via input line 405. If the limit switch 404 is open, the control unit 400 sets line 406 high and 404 low so that gate 426, as further shown in FIG. 8, connects the speed control line 425 to +Vc via a 4.7K ohm resistor 423. Then the workpiece rotation motor Mw regulator, comprising a conventional 4-quandrant regulator 424 and tachogenerator 29, activates the workpiece rotation motor Mw to rotate the workpiece 14 to a desired $V_2$ start-stop position. Switch 404 closes upon reaching the start-stop position whereupon the control unit 400 senses the closing and turns off the motor Mw by turning off the signal on line 406**.

Now that the grinder carriage 2 and wheel 1 and the workpiece 14 are in their desired starting positions, the control unit 400 outputs a rapid transverse E forward signal on line **415*b* to obtain contact between the grinder wheel 1 and workpiece 14. At this time the grinder motor Ms is driving the grinding wheel 1 and the wheel 1 is rotating. The grinder motor Ms is an AC motor interfaced to three phase power lines via a conventional frequency converter 410. The frequency converter 410 employs a three phase rectifier bridge to convert to DC and an inverter to convert back to AC at a variable frequency so that the speed of the grinder motor Ms may be varied with the frequency. The grinder motor current Im and voltage Um are multiplied by multiplier 412, consisting of four quandrant multipliers 514, 514*b*, 514*c* and lowpass filters 530 and 531 shown in FIG. 10, to generate a power signal, which is fed to three threshold detectors 414, 430, and 432. The threshold detectors are realized by op amp comparators 418, 240, and 238 respectively in the detector circuits generally designated 325 in FIG. 8. Op amp detector 418 is isolated from the other two op-amps 240 and 238 by resistor 422, nominally 100K, and compares the rate of change of the grinder motor Ms power to a low threshold preset by potentiometer 420, nominally 100K, to determine if there is a significant change in power to indicate on control unit input line 418 whether contact between the grinder wheel 1 and the burr 15 of the workpiece 14 has occurred. The control unit 400 presents a low, disabling signal on output line 416 that inhibits gate 250 to block the $V_1$ forward and inhibits gate 252 to block the $V_1$ reverse signal. A high, disabling input or gate 250 forces its output low, thereby inhibiting transmission gate 442 from passing the $V_1$ forward potential preset on potentiometer 448, nominally 5K, to the summing output node 434. Similarly gate 252 is inhibited thereby inhibiting transmission gate 446 from passing the $V_2$ reverse potential preset on potentiometer 444, nominally 5K ohms, to the summing output node 434. At this time the E forward signal on control unit output line 415*a* is set high by the control unit 400, thereby enabling transmission gate 452 and passing the +Vc supply voltage through resistor 454, nominally 4.7K, to the summing output node 434. This causes the grinder feed motor Mx to run at its maximum forward speed. Conversely, a high signal on line 415*b* enables transmission gate 456 and passes −Vc supply voltage through resistor 458, nominally 4.7K, to the summing output node 434. Line 415*a* is set high and 415*b* set low so that the grinder carriage 2 is driven forward until contact with the wheel 1 and burr 15 of the workpiece 14 occurs, thereby causing a sharp increase in the power to the grinder motor Ms so that threshold detector 414 is triggered, causing op amp 438 to send a logic high to the control unit 400. The control unit 400 responds by setting line 415*a* low to turn off rapid forward motion E and by momentarily pulsing line 415***b* to put a reversing torque on the armature of the grinder feed motor Mx to act as a brake, thereby slowing down the forward carriage 2 motion to below $V_1$, the rate for grinding into the workpiece 14.

Now that contact between the wheel 1 and workpiece 14 have been established, the control unit 400 switches on two-point control by setting output lines 416, 415*a*, and 415*b* low. When line 416 is set low, flip-flop 433, comprising gates 246 and 248 in FIG. 8, controls whether transmission gate 446 or 442 is enabled to actuate the grinder feed motor Mx to drive the grinder carriage 2 forward or reverse at a controlled velocity $V_1$ determined by the settings of potentiometers 448 or 444. Similarly, the control unit 400 sets output line 406 high, with line 404 low, to drive the workpiece rotation motor Mw at an optimum speed $V_2$ opt. The control voltage on line 425 is derived from the carriage drive tachogenerator 10 signal on line 434 using a unidirectional diode 459 to pass a forward motion signal and a resistor divider network comprising resistors 460 and 462 shown in FIG. 8 which set the ratio of $V_1$ to the tachogenerator 10 output, and potentiometer 468 which sets the absolute value of $V_1$ and potentiometer 428 which sets the value of C, the scaling factor for $V_2$ opt and is a speed control for the workpiece rotation motor Mw. Representative values are 2.2K for R468, 4.7K for R460 and 462, and 10K for R428.

During the grinding process, the control unit 400 looks for a closure of the cam operated switch 404 from a previously open state to detect whether the grinding of the burr 15 has proceeded completely around the workpiece 14, and if it has the control unit 400 turns off the workpiece rotation motor Mw by setting output line 404 low. Also, the grinder carriage 2 is rapidly retracted at E reverse velocity by turning two point control off by setting output line 416 high and by setting line 415*b* high. The control unit 400 then looks for a closure of the carriage limit switch 402 to detect when the carriage 2 has reached the starting position, whereupon the control unit 400 shuts off the grinder feed motor Mx by setting line 415*a* high and line 415*b* low.

Further improvement could be obtained by using digital signal processing. This is the preferred embodiment for use with numerically-controlled grinding machines already having an analog-to-digital converter input port and available processor time and memory. An analog signal proprtional to the circumferential force Pu is fed to the A/D converter; for example, the signal at the output of low-pass filter 531 in FIG. 10. The converter should be strobed at a continuous sampling rate, which should be a multiple of the AC power frequency to null out interference at these frequencies. On each sampling, which may be on interrupt, a numerical procedure is executed which digitally simulates differentiating, matched filtering by correlation, and threshold detection. Differentiation is achieved by substracting the prior, old sample from the present, new sample. Optionally, this time differential may be converted to a gradient differential by dividing the time differential by the measured velocity $V_1$ or the gradient may be calculated directly by using a sampling rate proportional to $V_1$ which could be derived by dividing down the tachogenerator 10 signal to a suitable slow rate with a digital counter. Matched filtering is achieved by pushing the difference into a $1 \times N$ pipeline array, and correlating it with a $1 \times N$ expected value array of predetermined values, corresponding to the slope of the pronounced edge in FIG. 3D, by performing a vector scalar product. A unity vector, resulting in just the summation of the last N differential values, corresponds to an assumed rectangular shape of the pronounced edge. The number of values N determines the response time of the detector, so that a response-time versus noise rejection tradeoff may be made. The result of the correlation is compared to predetermined threshold numbers to decide when to switch between the forward and reverse modes, or to decide when grinding wheel 1 contact occurs during the start-up positioning step.

Figure 11:
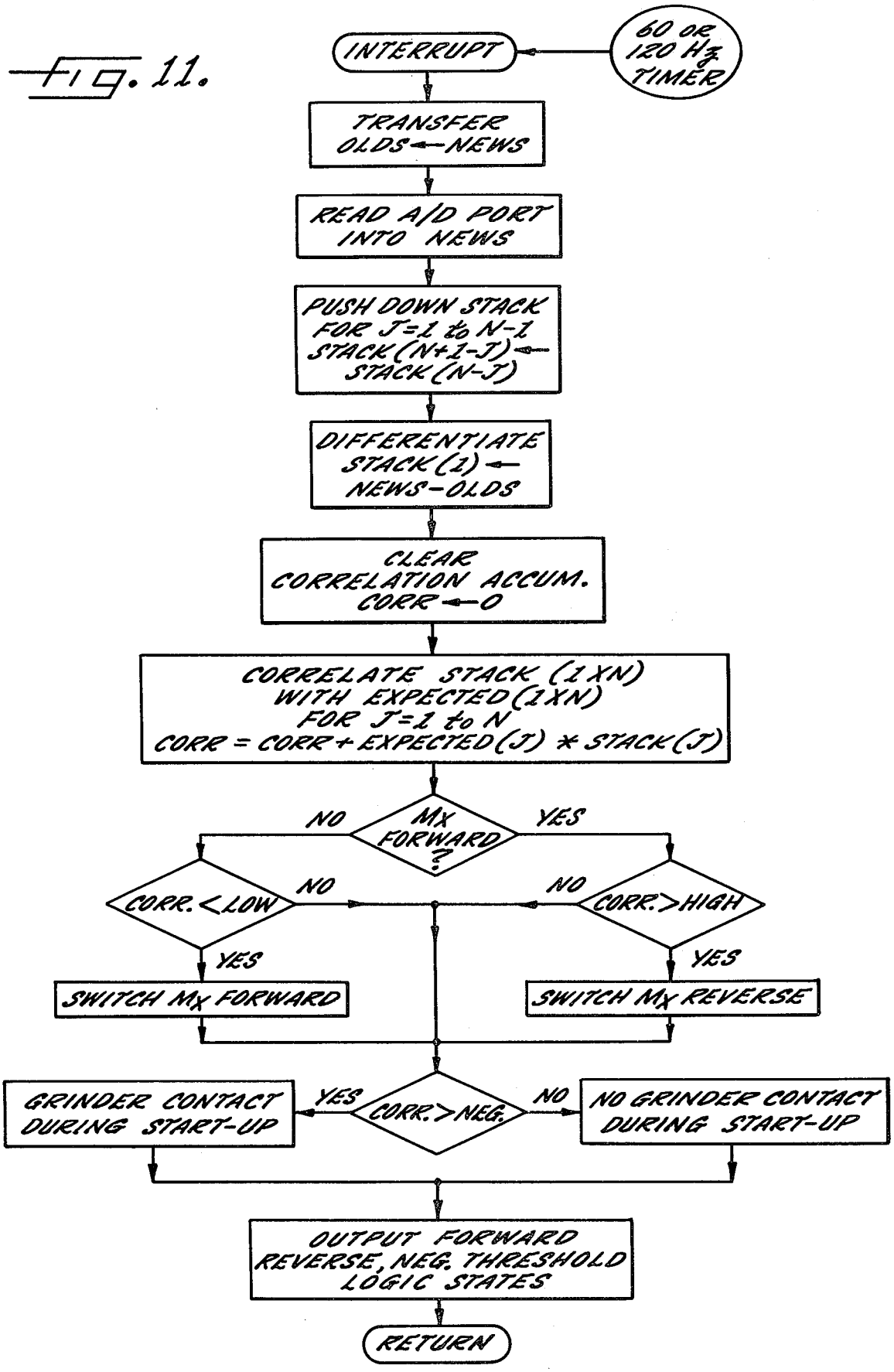
FIG. 11 is a flow diagram of an interrupt routine in the numerical control unit for performing the differentiation, matched filtering and threshold detection by numerical methods.

The advantages of digital filtering are apparent when the sampling rate is faster than the rise time of the pronounced edge in FIG. 3D. This will occur, for example, if a large grinding wheel 1 or grinding motor Ms is used and the inertia slows down the response of the sampled motor current or power to the circumferential force Pu. The expected value array should conform to the expected response of the sampled motor current or power in order to obtain maximum noise rejection provided by matched filtering. A sequence of numerical steps for correlating to an expected response of [1, 2, 3, 4, 4,] and detecting the presence of the workpiece 14 surface is shown in Table II listed at the end of the specification. A corresponding flow diagram is shown in FIG. 11.

While the invention is susceptible of various modifications and alternate constructions, it should be understood that there is no intention to limit the invention to the specific forms disclosed, but on the contrary, the intention is to cover all modifications, alternative constructions and equivalents falling within the spirit and scope of the invention as defined by the appended claims.

TABLE I

LISTING OF CONTROL UNIT PROCEDURE

```
START
P416 = 1                                  (INITIALIZE OUTPUTS)
P415A, P415B, P404, P406 = 0
OUTPUT P416, P415A, P415B, P404, P406
CALL SLIDE
GO TO ROTATE
SLIDE READ I403                           (CHECK CARRIAGE LIMIT)
IF (I403 = 1) GO TO ENDSLIDE
P415B = 1
OUPUT P415B                               (MOVE TO START POSITION
GO TO SLIDE                               OF CARRIAGE)
ENDSLIDE P415B = 0
OUTPUT P415B
RETURN
ROTATE READ I405                          (CHECK WORKPIECE ANGLE)
IF (I405 = 1) GO TO ENDROT
P404 = 1
OUTPUT P404                               (MOVE TO START POSITION
```

TABLE I-continued

| LISTING OF CONTROL UNIT PROCEDURE | |
|---|---|
| GO TO ROTATE | OF WORKPIECE ROTATION) |
| ENDROT P404 = 0 | |
| OUTPUT P404 | |
| CONTACT P415A = 1 | (MORE TO CONTACT POSITION) |
| OUTPUT P415A | (START FAST FORWARD) |
| READ I418 | (CHECK FOR POWER INCREASE) |
| IF (I418 = 0) GO TO CONTACT | |
| BRAKE P415A = 0 | (SET FAST REVERSE BRAKING) |
| P415B = 1 | |
| OUTPUT P415A, P415B | |
| CALL WAIT | (ENERGIZE FAST REVERSE FOR |
| P415B = 0 | PREDETERMINING DELAY TIME) |
| OUTPUT P415B | |
| GO TO TWOPOINT | |
| WAIT M1 = 255 | (M1 IS 8-BIT REGISTER) |
| M2 = 8 | (SET DELAY TIME FOR |
| LOOP M1 = M1-1 | REVERSE BRAKING) |
| IF (M1. NE 0) GO TO LOOP | |
| M2 = M2-1 | |
| IF (M2. NE. 0) GO TO LOOP | |
| RETURN | |
| TWOPOINT P416 = 0 | (ACTIVATE V1 FORWARD) |
| REVERSE = 0 | (SET REVERSE FLAG TO O |
| OUTPUT P416 | FOR INTERRUPT ROUTINE) |
| P406 = 1 | (ACTIVATE V2 OPT ROTATION) |
| OUTPUT P406 | (TWO POINT CONTROL OF) |
| | (GRINDING IN PROGRESS) |
| GRIND M405 = I405 | (SAVE OLD VALUE OF |
| CALL WAIT | MANDREL CAM SWITCH) |
| READ I405 | (WAIT FOR DE-BOUNCE) |
| IF (M405 = 1) GO TO GRIND | (LOOK FOR LOW-TO) |
| IF (I405 = 0) GO TO GRIND | (HIGH TRANSITION) |
| BACK P406 = 0 | (CAM AT STARTING ANGLE) |
| OUTPUT P406 | (TURN OFF V2 ROTATION) |
| CALL SLIDE | (MOVE CARRIAGE TO START |
| STOP | POSITION) |

TABLE II

| LISTING OF DIGITAL CORRELATION PROCEDURE | |
|---|---|
| INTERRUPT (ACTUATED BY 60 or 120 Hz TIMER) | |
| OLDS = NEWS | |
| READ NEWS | (READ D/A PORT) |
| | (PERFORM DIFFERENTIATION) |
| FOR J = 1 TO 4 | (PUSH NEW DIFFERENTIAL) |
| STACK (6-J) = STACK (5-J) | (VALVE INTO STACK) |
| NEXT J | |
| STACK (1) = NEWS − OLDS | |
| CORR = O | (CLEAR CORRELATOR ACCUMULATOR) |
| CORR = CORR + STACK (5) | CALCULATIVE VECTOR) |
| CORR = CORR + 2* STACK (4) | (SCALAR PRODUCT) |
| CORR = CORR + 3* STACK (3) | (MAXIMUM SLOPE = 15) |
| CORR = CORR + 4* STACK (2) | (ASSUMED FOR THRESHOLDS) |
| CORR = CORR + 4* STACK (1) | (GIVEN) |
| IF (REVERSE) GO TO REV | |
| IF (CORR. LT. 150) GO TO OUT | (TEST UPPER THRESHOLD) |
| REVERSE = 1 | (THRESHOLD EXCEEDED) |
| P248 = 1 | |
| P246 = 0 | |
| | (REVERSE GRINDER DRIVE MX) |
| GO TO OUT | |
| REV IF (CORR. GT. 50) GO TO OUT | (TEST LOWER THRESHOLD) |
| REVERSE = 0 | (THRESHOLD NOT EXCEEDED) |
| P248 = 0 | |
| P246 = 1 | |
| | (SWITCH TO FORWARD) |
| | (GRINDER DRIVE) |
| OUT IF (CORR. GT. 40) GO TO CONT | (CHECK LOW THRESHOLD FOR) |
| P418 = 0 | |
| GO TO END | (GRINDER CONTACT DURING) |
| CONT P418 = 1 | (START-UP PROCEDURE) |
| END OUTPUT P418, P248, P246 | (OUTPUT THRESHOLD DETECTOR |
| RETURN | LOGIC STATES) |

What we claim is:

1. In a grinding assembly for grinding off the molding fin from a rough casting on which the fin extends in a plane substantially at right angles to the surface of the casting, the combination comprising a grinding wheel having a rotary drive for rotating it at a reference speed, means including a carriage for mounting the grinding wheel for bodily relative movement in feed and return directions, means including a jig for mounting the casting in front of the grinding wheel, feed driving means for driving the carriage in the feed direction at a reference feed rate so that the grinding wheel grinds away the fin as it proceeds toward the surface of the casting, means for constantly measuring the load imposed upon the rotary drive and for producing an output signal which is a function of the load and which sharply increases in magnitude as the surface of the casting is encountered at the base of the fin, feed shut-off means for shutting off the feeding movement of the carriage, means responsive to the magnitude of the output signal for triggering the feed shut-off means to the shut-off condition upon sudden increase of the output signal indicating that the engaged portion of the fin has been removed and that the surface of the casting is being encountered, the shut-off means inhibiting the feeding movement of the carriage in the feed direction for a time greater than the response time of the feed driving means and means for imparting relative traversing movement to the casting.

2. In a grinding assembly for grinding off the molding fin from a circular casting on which the fin extends in a plane substantially at right angles to the axis of the casting, the combination comprising a grinding wheel having a rotary drive for rotating it at a reference speed, means including a carriage for mounting the grinding wheel for bodily relative movement in feed and return directions, means for chucking the casting in front of the grinding wheel for rotation about axis, feed driving means for driving the carriage in the feed direction at a reference feed rate so that the grinding wheel grinds away the fin as it proceeds toward the surface of the casting, means for constantly measuring the load imposed upon the rotary drive and for producing an output signal which is a function of the load and which sharply increases in magnitude as the surface of the casting is encountered at the base of the fin, feed shut-off means for shutting off the feeding movement of the carriage, means responsive to the magnitude of the output signal for triggering the feed shut-off means to the shut-off condition upon sudden increase of the output signal indicating that the surface of the casting is being encountered, the shut-off means inhibiting the feeding movement of the carriage in the feed direction for a time greater than the response time of the feed driving means and means for rotating the casting about its axis to provide circular traversing movement between the casting and the wheel for grinding off the fin about the entire periphery of the casting.

3. In a grinding assembly for grinding off the molding fin from a rough casting in which the fin extends in a plane substantially at right angles to the surface of the casting, the combination comprising a grinding wheel having a rotary drive for rotating it at a reference speed, means including a carriage for mounting the grinding wheel for bodily relative movement in feed and return directions, means including a jig for mounting the casting in front of the grinding wheel, feed driving means for driving the carriage in the feed direction at a reference feed rate so that the grinding wheel grinds away the fin as it proceeds toward the surface of the casting, means for constantly measuring the load imposed upon the rotary drive and for producing an output signal which is a function of the load and which sharply increases in magnitude as the surface of the casting is encountered at the base of the fin, means for shutting off the feeding movement of the carriage, means responsive to the magnitude of the output signal for triggering the shut-off means upon sudden increase of the output signal indicating that the engaged portion of the fin has been removed and that the surface of the casting is being encountered, means for thereafter retracting the carriage so that the wheel is retracted outward from the surface contour of the casting to complete a single feed and retract cycle, means for continuously repeating the cycle, and means for imparting relative traversing movement to the casting as the cycle is repeated.

4. In a grinding assembly for grinding off the molding fin from a rough casting in which the fin extends in a plane substantially at right angles to the surface of the casting, the combination comprising a grinding wheel having a rotary drive for rotating it at a reference speed, means including a carriage for mounting the grinding wheel for bodily relative movement in feed and retract directions, means including a jig for mounting the casting in front of the grinding wheel, feed driving means for driving the carriage in the feed direction from a reference position and at a reference feed rate so that the grinding wheel grinds away the fin as it proceeds toward the surface of the casting, means for constantly measuring the load imposed upon the rotary drive and for producing an output signal which is a function of the load and which sharply increases in magnitude as the surface of the casting is encountered at the base of the fin, means for shutting off the feeding movement of the carriage and for causing the carriage to retract through a predetermined distance to a new reference position to complete a single feed and retract cycle, means responsive to the magnitude of the output signal for triggering the feed shut-off means upon sudden increase of the output signal indicating that the engaged portion of the fin has been removed and that the surface of the casting is being encountered, means for imparting relative transversing movement to the casting, and means responsive to the carriage reaching its new reference position for automatically initiating an ensuing cycle of feeding movement, the predetermined distance of retraction being substantially less than the maximum protruding distance of the fin outward from the surface contour of the casting in the carriage retract direction.

5. The combination as claimed in claim 1 or claim 2 or claim 3 or claim 4 in which the output signal is proportional to the load on the rotary drive.

6. The combinaton as claimed in claim 1 or claim 2 or claim 3 or claim 4 in which a differentiating device is provided for responding to the load measuring means to produce an output signal which is a first derivative function of the load.

7. The combination as claimed in claim 1 or claim 2 or claim 3 or claim 4 in which means are provided for responding to the load measuring means to produce an output signal which is an exponential function of the load and in which the exponent is greater than one.

8. The combination as claimed in claim 1 or claim 2 or claim 3 or claim 4 in which the rotary drive for the wheel is in the form of an electric motor and in which the means for constantly measuring the load imposed thereon is in the form of motor current measuring means.

9. The combination as claimed in claim 1 or claim 2 or claim 3 or claim 4 in which the rotary drive for the wheel is in the form of an electric motor and in which the means for constantly measuring the load imposed thereon is in the form of torque measuring means for measuring the reaction torque imposed upon the wheel by the casting.

10. The combination as claimed in claim 1 or claim 2 or claim 3 or claim 4 in which an adjustable source of reference signal is provided and in which the means responsive to the magnitude of the output signal is in the form of a comparator for comparing the reference signal to the output signal for triggering the feed shut-off means when the output signal bears a predetermined relation to the reference signal.

11. The combination as claimed in claim 3 or claim 4 in which the rate of retracting movement of the carriage greatly exceeds the rate of feeding movement.

12. The combination as claimed in claim 1 or claim 2 or claim 3 or claim 4 in which the plane of the fin substantially intersects the center of the wheel.

13. The combination as claimed in claim 1 or claim 2 or claim 3 or claim 4 in which the plane of the fin is parallel to the wheel axis.

14. The combination as claimed in claim 1 or claim 2 or claim 3 or claim 4 in which means are provided for maintaining the speed of traversing movement of the casting substantially constant.

15. The combination as claimed in claim 1 or claim 2 or claim 3 or claim 4 in which the means for imparting relative traversing movement to the casting is in the form of indexing means so that the casting is traversed in stepped increments.

16. The combination as claimed in claim 1 or claim 2 or claim 3 or claim 4 in which the means for imparting relative traversing movement to the casting is in the form of indexing means with means for synchronizing the indexing movements with the feed movements of the carriage.

17. The combination as claimed in claim 1 or claim 3 or claim 4 in which the casting is mounted for rotational movement about an axis which is substantially perpendicular to the plane of the fin.

18. The combination as claimed in claim 1 or claim 3 or claim 4 in which the means for imparting relative traversing movement to the casting causes the casting to be translated in front of the grinding wheel in the plane of the fin.

19. In a grinding assembly for grinding off the molding fin from a rough casting in which the fin extends in a plane substantially at right angles to the surface of the casting, the combination comprising a grinding wheel having a rotary drive for rotating it at a reference speed, means including a carriage for mounting the grinding wheel for bodily relative movement in feed and return directions, means including a jig for mounting the casting in front of the grinding wheel, feed driving means for driving the carriage in the feed direction at a reference feed rate so that the grinding wheel grinds away the fin as it proceeds toward the surface of the casting, means for detecting the contour of the workpiece by engagement of the grinding wheel with the workpiece as the fin is removed and generating an output signal indicating the actual contact area between the grinding wheel and the workpiece so that the output signal sharply increases in magnitude as the surface of the casting is encountered at the base of the fin, means for shutting off the feeding movement of the carriage, means responsive to the magnitude of the output signal for triggering the shut-off means upon adding increase of the output signal indicating that the engaged portion of the fin has been removed and that the surface of the casting is being encountered, means for thereafter retracting the carriage so that the wheel is retracted outward from the surface contour of the casting to complete a single feed and retract cycle, means for continuously repeating the cycle, and means for imparting relative traversing movement to the casting as the cycle is repeated.

20. The combination as claimed in claim 19, in which the means for detecting the contour of the workpiece has a differentiating device and wherein the output signal indicates the time rate of change of the actual contact area between the grinding wheel and the workpiece.

* * * * *